US007118490B2

(12) United States Patent
Namba

(10) Patent No.: US 7,118,490 B2
(45) Date of Patent: Oct. 10, 2006

(54) GOLF SWING TRAINING TOOL

(76) Inventor: Teruki Namba, 2-3-19, Hirano, Kashiwara-shi, Osaka-fu (JP)

( * ) Notice: Subject to any disclaimer, the term of this patent is extended or adjusted under 35 U.S.C. 154(b) by 0 days.

(21) Appl. No.: 11/085,062

(22) Filed: Mar. 22, 2005

(65) Prior Publication Data

US 2005/0215339 A1 Sep. 29, 2005

(30) Foreign Application Priority Data

Mar. 24, 2004 (JP) ..... 2004-086432

(51) Int. Cl.
*A63B 69/36* (2006.01)

(52) U.S. Cl. ..... 473/228; 473/226

(58) Field of Classification Search ..... 473/206, 473/219, 226, 228, 451, 457
See application file for complete search history.

(56) References Cited

U.S. PATENT DOCUMENTS 5,100,148 A * 3/1992 Smith ..... 473/228
5,207,625 A * 5/1993 White ..... 482/111
5,310,188 A * 5/1994 Hernberg ..... 473/206
5,415,406 A * 5/1995 Reichenbach et al. ..... 473/228
5,571,048 A * 11/1996 Kenney ..... 473/228
6,238,299 B1 * 5/2001 Barnette ..... 473/228
6,881,156 B1 * 4/2005 Phillips ..... 473/228
2003/0207719 A1 * 11/2003 Hughes ..... 473/228

FOREIGN PATENT DOCUMENTS

JP 59-175 1/1984

* cited by examiner

*Primary Examiner*—Nini F. Legesse
(74) *Attorney, Agent, or Firm*—Wenderoth, Lind & Ponack, L.L.P.

(57) ABSTRACT

A golf swing training tool comprises a plurality of blade portions and an attaching portion for detachably attaching these blade portions to an axial member for golf swinging, wherein the blade portions are radially disposed around an axis of the axial member when being attached to the axial member.

18 Claims, 4 Drawing Sheets

GOLF SWING TRAINING TOOL

BACKGROUND OF THE INVENTION

1. Field of the Invention

The present invention relates to a golf swing training tool.

2. Description of the Background Art

Prior, as golf swing training tools, ones made by mounting weights on shafts or heads of golf clubs have been provided. However, with such training tools, a centrifugal force owing to this weight is produced during swinging, which merely imposes an excessive burden on the body and has no effect on building muscle strength required for swinging, and, what is more, there is also a problem of throwing a swing form off balance.

Therefore, a golf swing training tool as in Japanese Published Unexamined Utility Model Application No. S59-175 has been proposed. This golf swing training tool intends to build muscle strength during swinging by increasing air resistance during swinging by attaching an air resistor made of a lightweight material in place of a weight.

However, this golf swing training tool has an air resistor which is provided by forming a lightweight material such as urethane foam or styrene foam in a polyhedron form such as a sphere, a column, or a cube and, therefore, has a problem in that it hardly receives sufficient air resistance.

In addition, since the air resistor is fixedly fitted to a shaft, there is also a problem in that swinging practice with use of a golf club to be used in actual play is impossible.

SUMMARY OF THE INVENTION

A golf swing training tool of the present invention has been proposed in view of problems as described above, and encompasses a plurality of blade portions and an attaching portion for detachably attaching these blade portions to an axial member for golf swinging, wherein the blade portions are radially disposed around an axis of the axial member when being attached to the axial member.

In addition, the blade portions may be turnable (revolvable) with respect to the axial member.

Furthermore, the blade portions may be collapsible when being removed from the axial member.

In the golf swing training tool of the present invention, since a plurality of blade portions have been radially disposed around the axis of the axial member, air resistance during swinging can be sufficiently received by respective blade portions. As a result, without imposing an excessive burden on the body, muscle strength building required for swinging can be realized. In addition, since the golf swing training tool of the present invention can be attached to a golf club, swinging practice with use of a golf club to be actually used in play is possible. Accordingly, not only is it economical since a single golf club is sufficient, but there is also an advantage in that training and play can be comfortably performed without a sense of discomfort owing to a dimensional difference in a grip or shaft.

In addition, for a golf swing training tool whose blade portions have been provided so as to be revolvable with respect to the axial member, during swinging, concretely, during each action from a top-swing to a down-swing, at impact, up to follow-through, the blade portions turn clockwise or counterclockwise with respect to an axial portion depending on a direction of air resistance that this air resistor receives. Since a user can visually check habits in his/her swing form during each action, he/she can overcome bad habits in his/her swing form and acquire a correct swing form.

Furthermore, for a golf swing training tool whose blade portions are collapsible when being removed from the axial member, since a size can be reduced for storing, there is no problem of storage, which is convenient.

DETAILED DESCRIPTION OF THE PREFERRED EMBODIMENTS

Hereinafter, an embodiment of the present invention will be described in detail.

Figure 1:
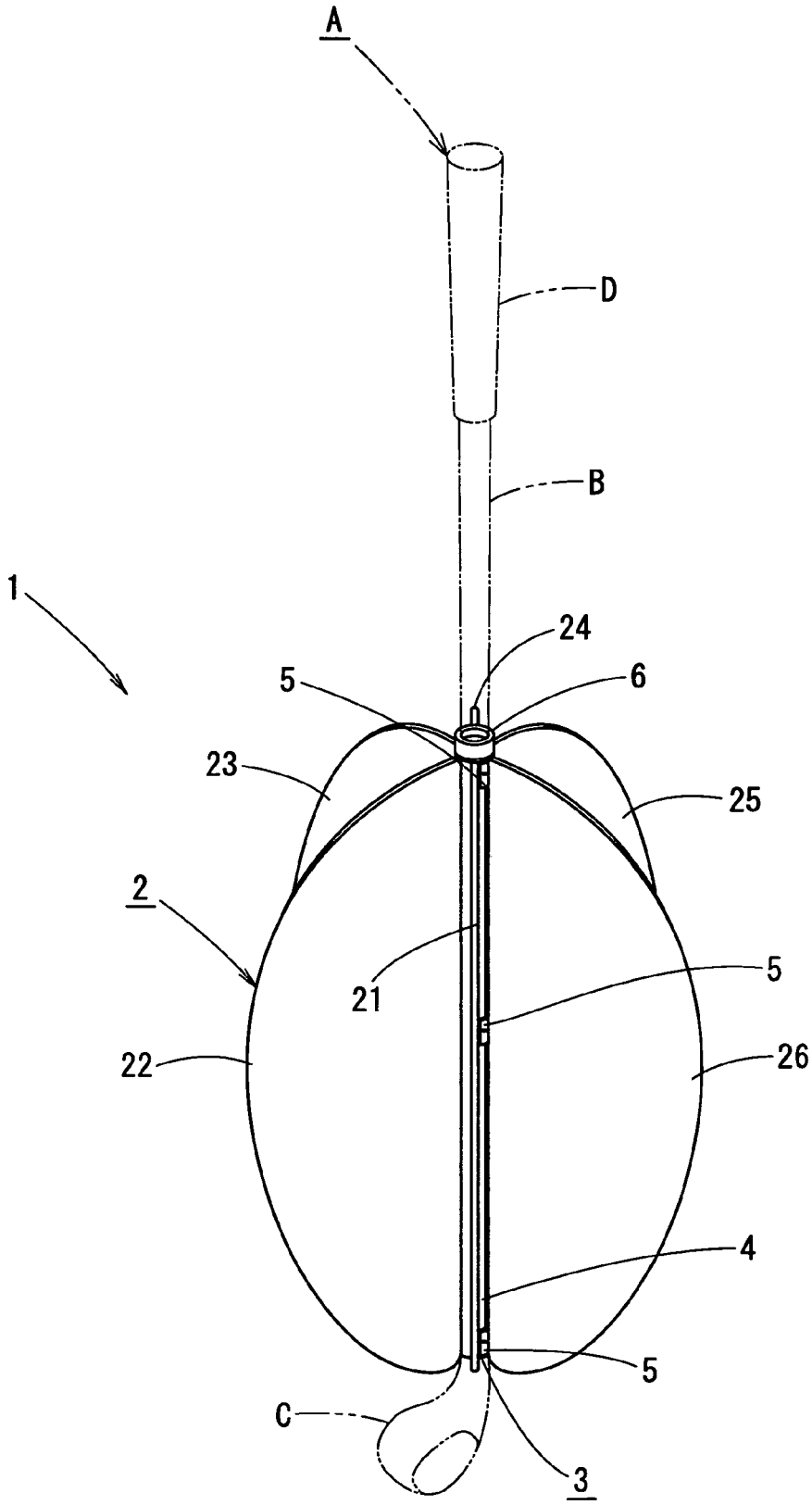
FIG. 1 is a perspective view showing an attached condition of a golf swing training tool 1 of an embodiment of the present invention.

A golf swing training tool 1 of the present embodiment comprises, as shown in FIG. 1, blade portions 2 and an attaching portion 3 for detachably attaching the blade portions 2 to a shaft B.

The attaching portion 3 comprises an attaching body 4, attaching/detaching portions 5 for detachably attaching the attaching body 4 to the shaft B, and a stopper 6 for preventing, when being attached to the shaft B, the attaching body 4 from shifting in an axial direction of the shaft B. The attaching body 4 is formed of a flexible thin-walled plate material made of a synthetic resin, and is formed in an approximately rectangular form so as to cover an outer circumferential surface of the shaft B. And, a longitudinal length of the attaching body 4 is almost equal to a length of an axial central portion of the shaft B to a base portion of a head C, and a widthwise length thereof is formed slightly longer than an outer circumferential length of the shaft B so that, when the attaching body 4 is attached to the shaft B, a diameter of the attaching body is one size larger than an outer diameter of the shaft B.

Similar to the attaching body 4, the attaching/detaching portions 5 are made of a synthetic resin, which are for detachably connecting both widthwise end portions of the attaching body 4. Concretely, as shown in FIG. 1 to FIG. 4, each attaching/detaching portion 5 is provided with a latching portion 7 formed at one widthwise end portion of the attaching body 4, and a to-be-latched portion 8 formed at another widthwise end portion.

The latching portion 7 consists of an approximately rectangular latching piece 72 having a fitting hole 71 at its center, and this is provided at a total of three positions of both upper and lower end portions and a central portion of the attaching body 4, integrally with the attaching body 4. On the other hand, the to-be-latched portion 8 consists of a projection 81 fittable to each fitting hole 71 of the latching portion 7, and similar to the latching portions 7, this is provided at a total of three positions of both upper and lower end portions and a central portion of the attaching body 4, integrally with the attaching body 4.

Figure 2:
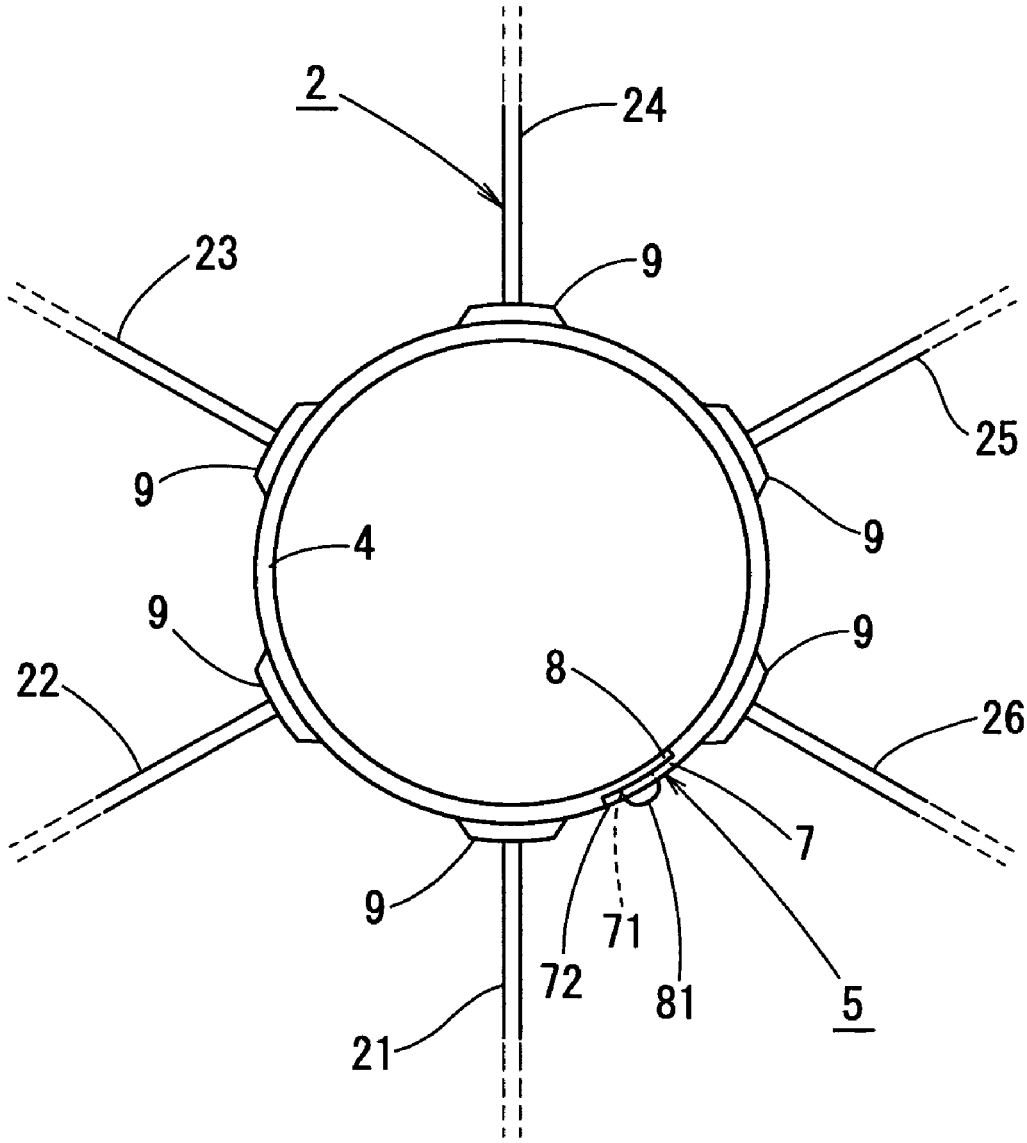
FIG. 2 is an explanatory view showing a main part of the golf swing training tool 1 shown in FIG. 1.
Figure 3:
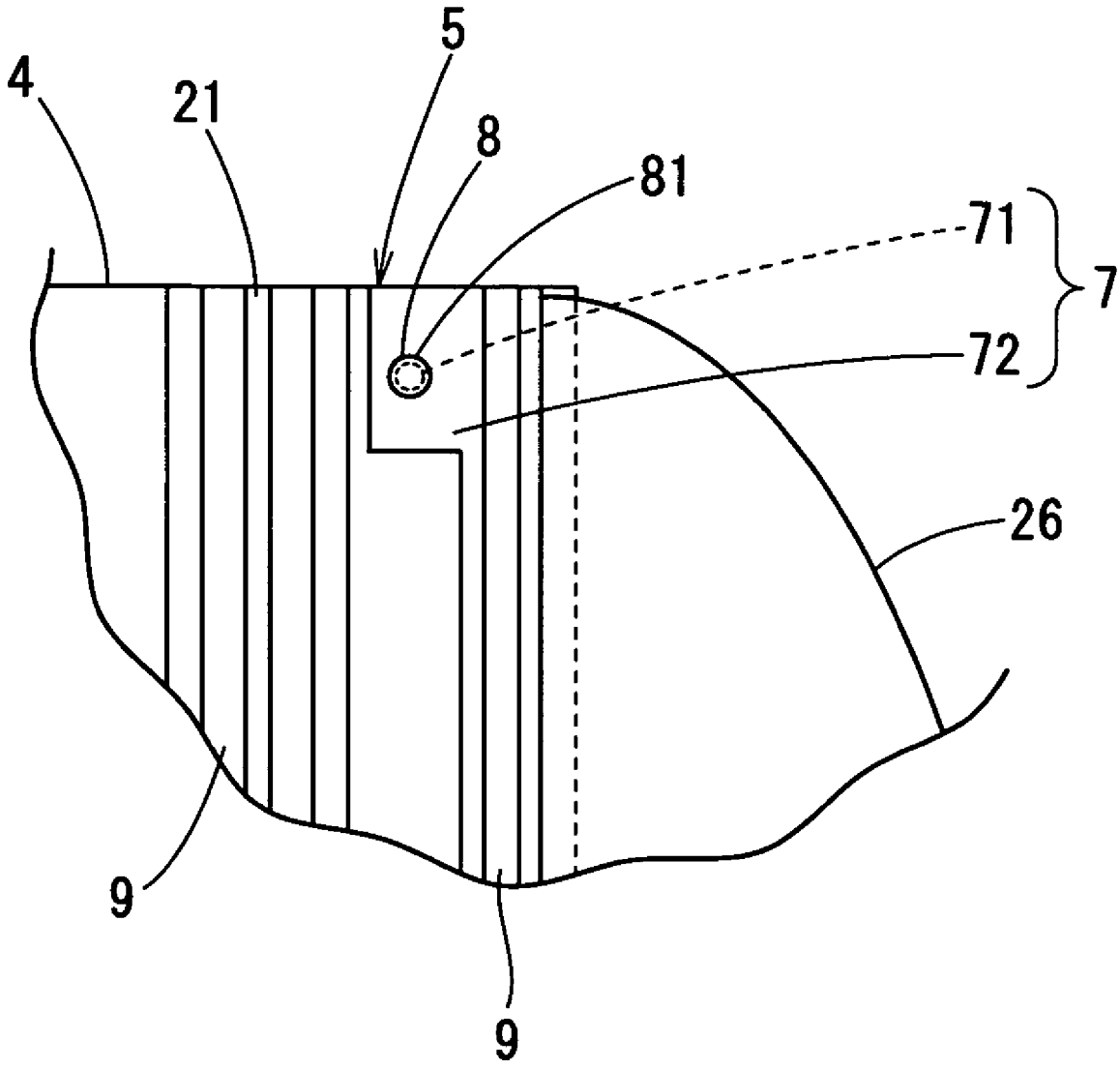
FIG. 3 is an explanatory view showing a main part of the golf swing training tool 1 as shown in FIG. 2.

The blade portions 2 are formed of lightweight and high-strength thin-walled plate material made of a synthetic resin, wherein one end portion is linear while another end portion is formed in an arc-like approximately semicircular form. The blade portions 2 are composed of, as shown in FIG. 1 and FIG. 2, six blades 21–26, and on one end portion of each blade portion 2, a reinforcing rib 9, whose width is broader than a thickness width of the blade portion 2, is continuously provided. The blade portions 2 are fixedly fitted to the attaching body 4 via the reinforcing ribs 9, and these respective blades 21–26 are disposed at approximately equal intervals with respect to the attaching body 4.

The stopper 6 is formed in a ring form by a material elastically deformable in a radial direction, for example, a synthetic rubber or the like. An inside diameter of the stopper 6 is smaller than an outside diameter of the shaft B in a natural state.

Usage procedures of the golf swing training tool 1 constructed as in the above will be described. First, the golf swing training tool 1 is attached to a golf club A. Concretely, it is arranged so that, of the attaching body 4, a surface opposite an attaching side of the blade portions 2 is opposed to the outer circumferential surface of the shaft B of the golf club A, and the attaching body 4 is wrapped around the shaft B. And, while the latching pieces 72 of the latching portions 7 are overlapped with the end portions of the to-be-latched portions 8, each respective projection 81 is fitted in a respective fitting hole 71, whereby the latching portions 7 are latched with the to-be-latched portions 8. The golf swing tool 1 is, as shown in FIG. 1, arranged from the axial central portion of the shaft B to the base portion of the head C, and the attaching body 4 is provided in a manner alienated by a predetermined distance from the shaft B. On the other hand, the blade portions 2 are radially disposed around an axis of the shaft B. Lastly, the stopper 6 is inserted over the shaft B from a grip D side and is arranged above the attaching body 4.

Next, a user practices swinging by use of the golf club A to which the golf swing training tool A has been attached.

During swinging practice, the blade portions 2 receive air resistance and turn clockwise or counterclockwise with respect to the shaft B. The user can recognize habits in his/her swing form and a degree thereof, during each action from a top-swing to down-swing, at impact, up to follow-through, by visually checking in which direction the blade portions 2 revolve. Accordingly, the user can overcome bad habits in his/her swing form and acquire a correct swing form.

Figure 4:
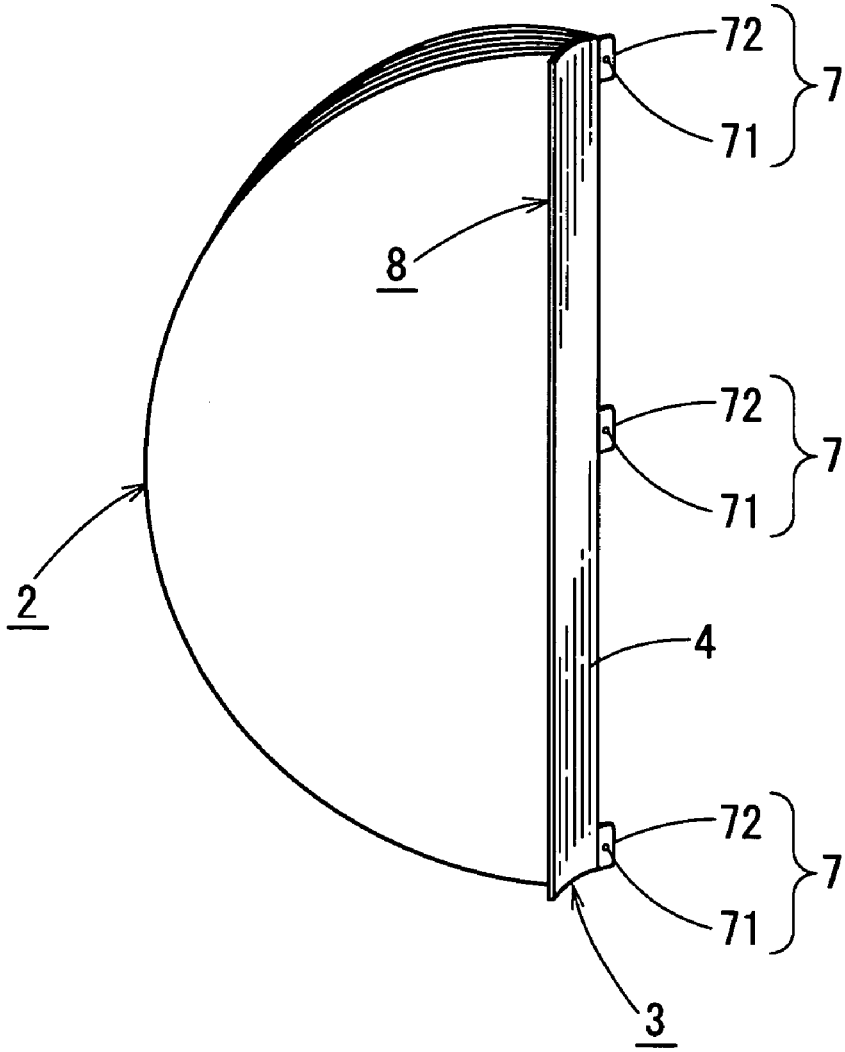
FIG. 4 is a perspective view showing a collapsed condition of the golf swing training tool 1 shown in FIG. 1.

After usage, in reverse to attaching procedures, first, the stopper is removed from the golf club A, and next, the attaching portion 3 is removed from the shaft B. And, as shown in FIG. 4, the attaching body 4 is opened into a plane form and is collapsed to either side so that the blade portions 2 are overlapped. By this manner, since the radially arranged respective blade portions 2 are collected at one position, an overall size of the golf swing training tool 1 can be downsized for easy storing.

Here, a mechanism of the attaching/detaching portion 5 is not limited to that described in the present invention, and it is sufficient as long as it has a mechanism capable of detachably connecting both widthwise end portions of the attaching body 4. Namely, it may be a mechanism for forming a latching claw on the latching portion 7, forming a latching hole on the to-be-latched portion 8, and detachably joining these together, or may be a mechanism for respectively attaching magnets to the latching portion 7 and to-be-latched portion 8 and attaching these to each other.

In addition, although the golf swing training tool 1 of the present embodiment has the stopper 6, a material, shape, mechanism and the like of the stopper 6 are not limited to those described above. It is sufficient that the stopper 6 can prevent the attaching body 4 from shifting. For example, a rope or string may be tied on the shaft B, or a clip or the like provided with a pair of pinching pieces may be attached to the shaft B.

In addition, the blade portions 2, attaching body 4, and attaching/detaching portions 5 are not limited to be made of a synthetic resin, and may be composed of paper materials, for example. The number of the blade portions 2 is not limited to six, and may be more or less.

Furthermore, although the golf swing training tool 1 of the present embodiment has been constructed so that the blade portions 2 revolve with respect to the shaft B, the blade portions 2 may not revolve. Since the blade portions 2 effectively receive air resistance, without imposing an excessive burden on the body, muscle strength building required for swinging can be realized. In this case, since fixing the attaching body 4 to the shaft B is sufficient, the stopper 6 is unnecessary.

Although the golf swing training tool 1 of the present embodiment is based on a premise that this is attached to a golf club, an attaching object is not limited to golf clubs. It can also be utilized when practicing sports that involve swinging such as tennis and Kendo (Japanese fencing), for example, and can also be attached for use to a racket or bamboo sword, or moreover, to a rod of an appropriate shape. In addition, as a matter of course, a size and shape of the swing training tool may be appropriately changed according to an object to which it is attached.

What is claimed is:

1. A swing training tool comprising:

blade portions; and an attaching portion for detachably attaching said blade portions to an axial member, such that when said blade portions are attached to the axial member said blade portions are radially disposed around the axial member and revolvable around the axial member, wherein said attaching portion includes a flexible thin-walled plate having edge portions which are connectable to one another, such that when said edge portions are connected to one another said thin-walled plate defines an aperture to receive the axial member, with a dimension of the aperture being greater than a diameter of the axial member.

2. The swing training tool according to claim 1, wherein each of said blade portions comprises a thin-walled plate having two end portions, with one of said end portions being linear and another of said end portions being semicircular.

3. A swing training tool comprising:

blade portions; and an attaching portion for detachably attaching said blade portions to an axial member, such that when said blade portions are attached to the axial member said blade portions are radially disposed around the axial member and revolvable around the axial member, wherein each of said blade portions comprises a thin-walled plate having two end portions, with one of said end portions being linear and another of said end portions being semicircular.

4. The swing training tool according to claim 3, wherein said blade portions are collapsible.

5. A swing training tool comprising:

blade portions; and an attaching portion for detachably attaching said blade portions to an axial member, such that when said blade portions are attached to the axial member said blade portions are radially disposed around the axial member, said attaching portion including (i) an attaching body formed of a flexible thin-walled plate, and (ii) attaching/detaching portions for connecting edge portions of said flexible thin-walled plate, such that when said edge portions are connected by said attaching/detaching portions said attaching body defines an aperture to receive the axial member, with a dimension of the aperture being greater than a diameter of the axial member.

6. The swing training tool according to claim 5, wherein the dimension of the aperture is greater than the diameter of the axial member such that said blade portions are revolvable around the axial member when attached to the axial member.

7. The swing training tool according to claim 6, wherein said blade portions are collapsible.

8. The swing training tool according to claim 7, wherein each of said blade portions comprises a thin-walled plate having two end portions, with one of said end portions being linear and another of said end portions being semicircular.

9. The swing training tool according to claim 5, wherein said blade portions are collapsible.

10. The swing training tool according to claim 9, wherein each of said blade portions comprises a thin-walled plate having two end portions, with one of said end portions being linear and another of said end portions being semicircular.

11. The swing training tool according to claim 5, wherein each of said blade portions comprises a thin-walled plate having two end portions, with one of said end portions being linear and another of said end portions being semicircular.

12. A swing training tool comprising:

blade portions; and an attaching portion for detachably attaching said blade portions to an axial member, such that when said blade portions are attached to the axial member said blade portions are radially disposed around the axial member, said attaching portion including (i) an attaching body formed of a flexible thin-walled plate having a first edge portion and a second edge portion, (ii) a first attaching/detaching portion on said first edge portion of said thin-walled plate, and (iii) a second attaching/detaching portion on said second edge portion of said thin-walled plate, wherein said first attaching/detaching portion is connectable to said second attaching/detaching portion, such that when said blade portions are to be attached to the axial member said thin-walled plate is deformed around the axial member and said first attaching/detaching portion is connected to said second attaching/detaching portion.

13. The swing training tool according to claim 12, wherein when said first attaching/detaching portion is connected to said second attaching/detaching portion so as to attach said blade portions to the axial member, an aperture is defined by said attaching portion, with a dimension of the aperture being greater than a diameter of the axial member such that said blade portions are revolvable around the axial member.

14. The swing training tool according to claim 13, wherein said blade portions are collapsible.

15. The swing training tool according to claim 14, wherein each of said blade portions comprises a thin-walled plate having two end portions, with one of said end portions being linear and another of said end portions being semicircular.

16. The swing training tool according to claim 12, wherein said blade portions are collapsible.

17. The swing training tool according to claim 16, wherein each of said blade portions comprises a thin-walled plate having two end portions, with one of said end portions being linear and another of said end portions being semicircular.

18. The swing training tool according to claim 12, wherein each of said blade portions comprises a thin-walled plate having two end portions, with one of said end portions being linear and another of said end portions being semicircular.

* * * * *